US006695245B1

(12) United States Patent
Schultz et al.

(10) Patent No.: US 6,695,245 B1
(45) Date of Patent: Feb. 24, 2004

(54) TURN-UP APPARATUS AND METHOD

(75) Inventors: Daniel John Schultz, Appleton, WI (US); Frank Stephen Hada, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/318,831

(22) Filed: Dec. 13, 2002

(51) Int. Cl.[7] ..... B65H 18/10; B65H 75/28

(52) U.S. Cl. ..... 242/532.2; 242/532.3; 242/581; 242/583

(58) Field of Search ..... 242/532.2, 532.3, 242/535.4, 541.1, 541.3, 541.4, 541.7, 547, 581, 583

(56) References Cited

U.S. PATENT DOCUMENTS

| | | | | |
|---|---|---|---|---|
| 1,868,115 A | * | 7/1932 | Mulligan | 242/532.2 |
| 3,321,149 A | | 5/1967 | Andersen et al. | |
| 4,555,070 A | | 11/1985 | Pali | |
| 5,252,170 A | | 10/1993 | Schaupp | |
| 5,607,551 A | | 3/1997 | Farrington, Jr. et al. | |
| 5,672,248 A | | 9/1997 | Wendt et al. | |
| 5,901,918 A | | 5/1999 | Klerelid et al. | |
| 5,944,273 A | | 8/1999 | Lin et al. | |
| 6,073,824 A | | 6/2000 | Gray et al. | |
| 6,171,442 B1 | | 1/2001 | Farrington, Jr. et al. | |
| 6,253,818 B1 | | 7/2001 | Preinknoll | |
| 6,412,729 B2 | * | 7/2002 | Kury et al. | 242/532.2 |
| 6,425,512 B2 | | 7/2002 | Hill et al. | |
| 6,443,387 B1 | | 9/2002 | Mercer et al. | |
| 2003/0141403 A1 | * | 7/2003 | Eriksson et al. | 242/532.2 |

FOREIGN PATENT DOCUMENTS

EP 0 553 232 B1 4/1995

OTHER PUBLICATIONS

American Society for Testing Materials (ASTM) Designation: D 737–96, "Standard Test Method for Air Permeability of Textile Fabrics," pp. 207–211, published Apr. 1996.

TAPPI Official Test Method T 402 om–93, "Standard Conditioning and Testing Atmospheres for Paper, Board, Pulp Handsheets, and Related Products," published by the TAPPI Press, Atlanta, Georgia, revised 1993, pp. 1–3.

TAPPI Official Test Method T 411 om–89, "Thickness (Caliper) of Paper, Paperboard, and Combined Board," published by the TAPPI Press, Atlanta, Georgia, revised 1989, pp. 1–3.

* cited by examiner

*Primary Examiner*—John M. Jillions
(74) *Attorney, Agent, or Firm*—Scott A. Baum

(57) ABSTRACT

An apparatus and method for turning-up a web is disclosed that results in greater efficiency. The method has been found to work especially well when the web is a bulky tissue web, but is also suitable for other web materials. The apparatus includes a reel spool having a cylindrical surface, the cylindrical surface includes at least one axial line of adhesive and a plurality of apertures operatively connected to a source of vacuum.

36 Claims, 6 Drawing Sheets

TURN-UP APPARATUS AND METHOD

BACKGROUND

In the manufacture of various types of tissue products such as facial tissue, bath tissue, paper towels and the like, the dried tissue web or sheet coming off of the tissue machine is initially wound into a parent roll and temporarily stored for further processing. Sometime thereafter, the parent roll is unwound and the sheet is converted into a final product form.

New tissue reels and winders having an endless belt are disclosed in U.S. Pat. No. 5,901,918 entitled Apparatus and Method for Winding Paper issued May 11, 1999 to Klerelid et al. and Apparatus and Method For Winding Paper, U.S. patent application No. 10/265021 filed Oct. 4, 2002, both herein incorporated by reference in a manner consistent herewith. Belted reels are effective in the winding of tissue webs having a bulk of 6 cubic centimeters per gram or higher and a high level of softness, as characterized, for example, by an MD Max Slope of about 10 kilograms or less per 3 inches of sample width. Such reels and winding methods can be used to produce dimensionally correct and dimensionally stable parent rolls of such soft tissue webs having diameters on the order of 70 to 150 inches. Such parent rolls are disclosed and claimed in U.S. Pat. No. 5,944,273 entitled Parent Roll for Tissue Paper issued Aug. 31, 1999 to Lin et al. and herein incorporated by reference in a manner consistent herewith.

In winding the tissue web into a large parent roll, it required to either initially thread the paper machine to start winding or to terminate the winding of one roll while initiating winding on a new roll during a turn-up. However, as the winding speeds of belted reels are increased to production rates exceeding 3,600 fpm, effectuating an efficient turn-up or threading of the paper machine can be problematic, especially when producing high bulk tissue webs. Therefore, there is a need for a high level of turn-up and threading efficiency in order to manufacture such tissue webs cost effectively.

SUMMARY

These and other needs are met by the apparatus and method according to the present invention which includes a reel spool having a cylindrical surface, the cylindrical surface including at least one axial line of adhesive and a plurality of apertures operatively connected to a source of vacuum.

In another aspect, the invention resides in an apparatus including a reel spool having a cylindrical surface, the cylindrical surface including at least one axial line of adhesive and at least one axial line of a plurality of apertures operatively connected to a source of vacuum; a transfer belt mounted for rotation around a plurality of support rolls defining a predetermined path of travel, the predetermined path of travel having a winding region and a web transport region; a sensor measuring a deflection of the transfer belt in the winding region from the predetermined path of travel; an actuator for positioning the reel spool and the transfer belt relative to each other to vary the deflection; and a controller connected to the sensor and the actuator for controlling the deflection.

In another aspect the invention resides in a method including the steps of creating a vacuum inside of a reel spool, contacting the reel spool with a web, and the reel spool having a cylindrical surface, at least one axial line of adhesive, and a plurality of apertures.

BRIEF DESCRIPTION OF THE DRAWINGS

The above aspects and other features, aspects, and advantages of the present invention will become better understood with regard to the following description, appended claims, and accompanying drawings where:

DETAILED DESCRIPTION

Figure 1:
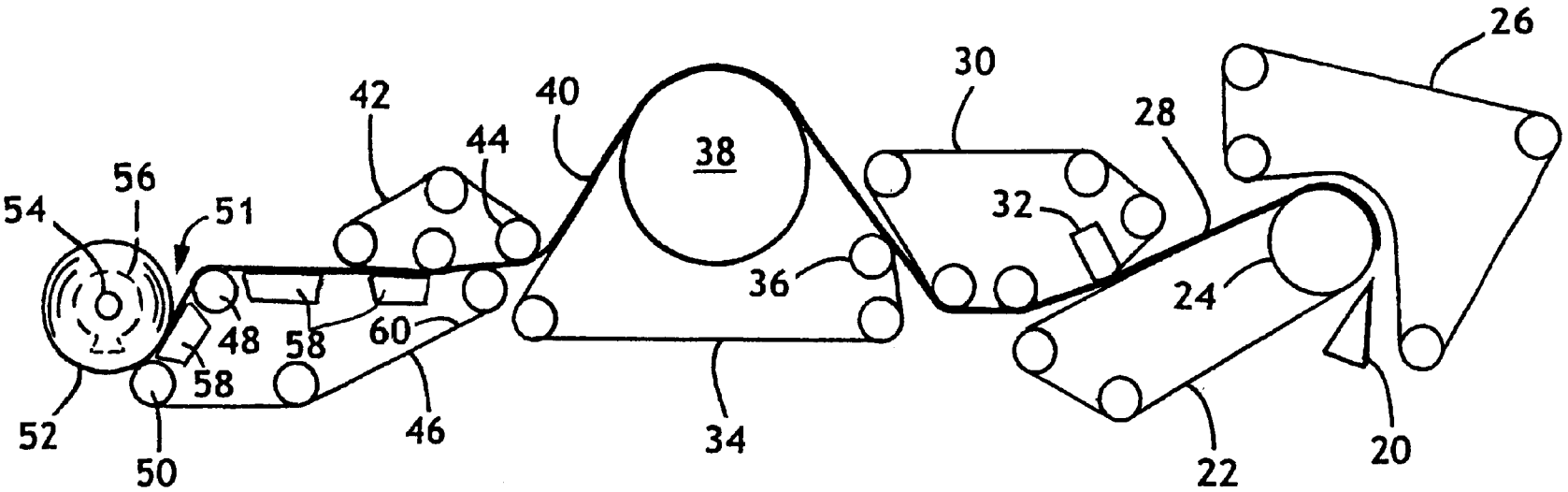
FIG. 1 illustrates a schematic process flow diagram of a method for making soft high bulk tissue sheets.

FIG. 1 illustrates a schematic flow diagram of a through-air drying process for making through-air dried tissue sheets. It should be understood, however, that the present invention could also be used with the creping process for tissue webs. Shown is a headbox 20 which deposits an aqueous suspension of papermaking fibers onto an inner forming fabric 22 as it traverses a forming roll 24. An outer forming fabric 26 serves to contain the web 28 while it passes over the forming roll and sheds some of the water. The wet web 28 is then transferred from the inner forming fabric to a wet end transfer fabric 30 with the aid of a vacuum transfer shoe 32. This transfer is preferably carried out with the transfer fabric traveling at a slower speed than the forming fabric (rush transfer) to impart stretch into the final tissue sheet. The wet web is then transferred to the through-air drying fabric 34 with the assistance of a vacuum transfer roll 36.

The through-air drying fabric 34 carries the web over a through-air dryer 38, which moves hot air through the web to dry it while preserving bulk. There can be more than one through-air dryer in series (not shown), depending on the speed and the dryer capacity. A dried tissue sheet 40 is then transferred to a first dry end transfer fabric 42 with the aid of vacuum transfer roll 44.

The tissue sheet, shortly after transfer, is sandwiched between the first dry end transfer fabric 42 and the transfer belt 46 to positively control the sheet path. The transfer belt can be air permeable or air impermeable depending on the specific type of tissue being produced. In one embodiment, the transfer belt can have an air permeability greater than about 50 cubic feet per minute per square foot of fabric ($cfm/ft^2$). In another embodiment, the transfer belt can have an air permeability from about 100 to about 300 $cfm/ft^2$. In another embodiment, the transfer belt can have an air permeability from about 125 to about 175 $cfm/ft^2$. Air permeability, which is the air flow through a fabric while maintaining a differential air pressure of 0.5 inches of water across the fabric, is tested in accordance with ASTM test method D737-96 entitled "Test Method for Air Permeability of Textile Fabrics." A copy of the test method is available from ASTM International having an office at 100 Barr Harbor Drive, West Conshohocken, Pa. 19428-2959 USA. The air permeability of the transfer belt 46 may be less than that of the first dry end transfer fabric 42, causing the sheet to naturally adhere to the transfer belt. At the point of separation, the sheet 40 can follow the transfer belt 46 due to vacuum action. In addition, the transfer belt 46 may be smoother than the first dry end transfer fabric 42 in order to enhance transfer of the sheet 40. To further effectuate a smooth transfer, a vacuum box, a coanda vacuum box, or other pressure reduction means can be located adjacent the transfer belt 46 to assist in transferring the sheet 40 to the transfer belt when the transfer belt is air permeable.

Suitable paper machine fabrics for use as transfer belts include, without limitation: A 96W fabric, having an air permeability of 150 cfm/ft$^2$, or a 934 fabric available from AstenJohnston having an office at 6480 W. College Avenue, Appleton, Wis., USA. A Montex VP fabric, having an air permeability of 50 cfm/ft$^2$, a T807, or a T1208-3 available from Voith Fabrics having an office at 2100 North Ballard Road, Appleton, Wis., USA.

Figure 2:
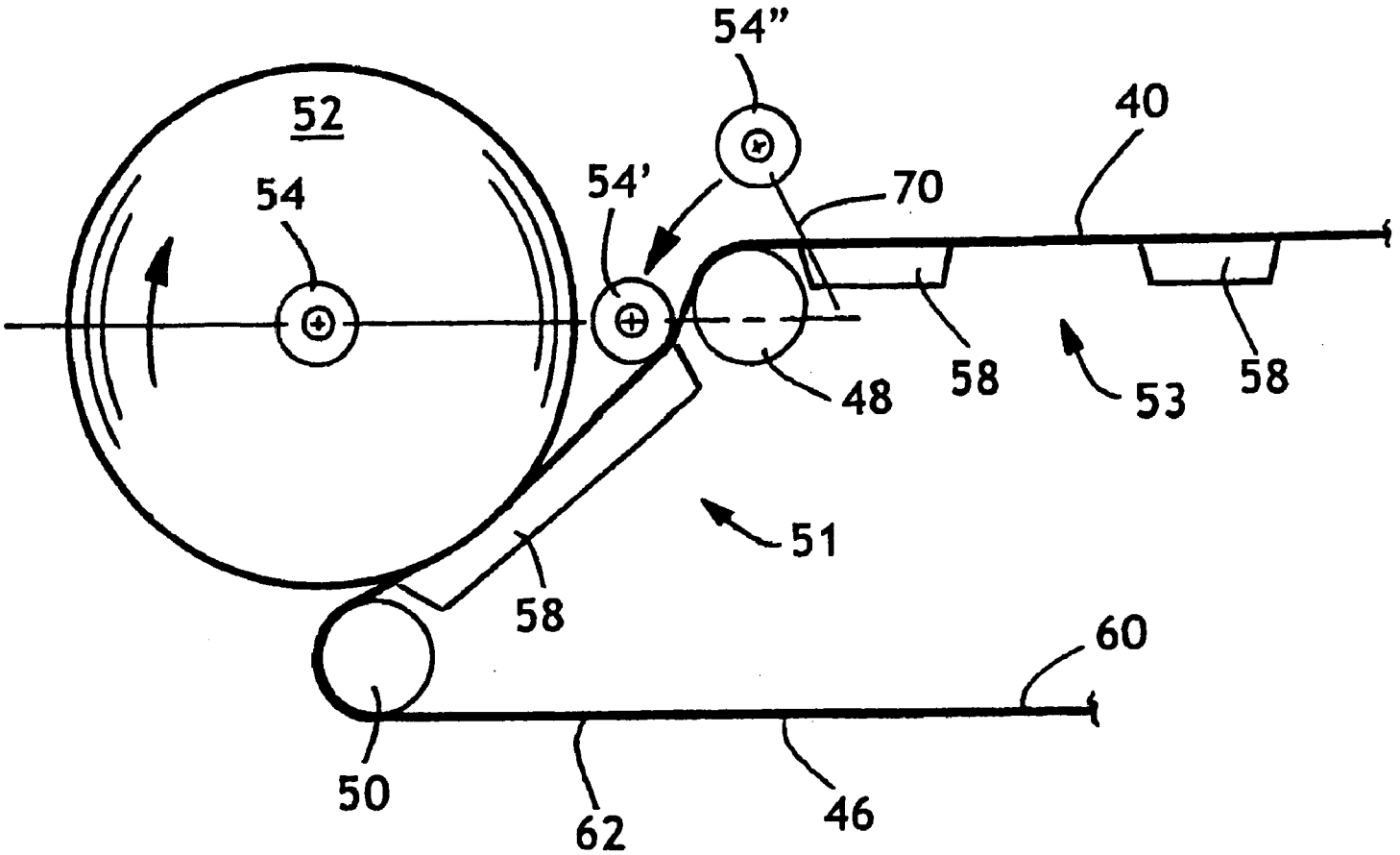
FIG. 2 illustrates a schematic diagram of the winding section of the method illustrated in FIG. 1.

The transfer belt 46 passes over two support rolls 48 and 50 having a free span between them, which defines a winding region 51 that includes the support rolls (FIG. 2). The portion of the transfer belt prior to the winding region upstream of roll 48 defines a web transport region 53 where the tissue sheet 40 is conveyed by the transfer belt 46 to the winding region 51. The transfer belt then returns to pick up the tissue sheet 40 again by use of one or more support or guide rolls as known to those of skill in the art. The tissue sheet is transferred to a parent roll 52 within the winding region 51. The parent roll 52 is wound on a reel spool 54, which is driven by a drive motor 56 acting on the shaft of the reel spool.

The dried tissue sheet 40 produced by the above process can be referred to as uncreped through-dried tissue. Uncreped through-dried tissues and products are disclosed in U.S. Pat. No. 5,607,551 entitled Soft Tissue issued Mar. 4, 1997 to Farrington Jr. et al., in U.S. Pat. No. 6,171,442 entitled Soft Tissue issued Jan. 9, 2001 to Farrington Jr. et al., and in U.S. Pat. 5,672,248 entitled Method of Making Soft Tissue Products issued Sep. 30, 1991 to Wendt et al. The disclosures of each herein incorporated by reference in a manner consistent herewith.

The Bulk of the uncreped through-dried tissue is calculated as the quotient of the Caliper (hereinafter defined), expressed in microns, divided by the basis weight, expressed in grams per square meter. The resulting Bulk is expressed as cubic centimeters per gram. For the dried tissue sheet 40, in various embodiments, the Bulks can be about 6 cubic centimeters per gram or greater, about 9 cubic centimeters per gram or greater, from about 9 to about 20 cubic centimeters per gram, from about 10 to about 15 cubic centimeters per gram, from about 9 to about 15 centimeters per gram, and from about 10 to about 12 centimeters per gram. The dried tissue sheets produced derive the Bulks referred to above from the basesheet, which is the sheet produced by the tissue machine without post treatments such as embossing. Nevertheless, the dried tissue sheet of this invention can be embossed to produce even greater bulk or aesthetics, if desired, or can remain unembossed. In addition, the dried tissue sheet of this invention can be calendered to improve smoothness or decrease the Bulk if desired.

The Caliper as used herein is the thickness of a single sheet, but measured as the thickness of a stack of ten sheets and dividing the ten sheet thickness by ten, where each sheet within the stack is placed with the same side up. Caliper is expressed in microns. It is measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is a Bulk Micrometer (TMI Model 49-72-00, Amityville, N.Y.) having an anvil diameter of 4$\frac{1}{16}$ inches (103.2 millimeters) and an anvil pressure of 220 grams/square inch (3.39 kiloPascals). After the Caliper is measured, the same ten sheets in the stack are used to determine the average basis weight of the sheets.

The softness of high bulk uncreped through-dried tissues can be characterized by a relatively lows tiffness as determined by the MD Max Slope and/or the MD Stiffness Factor, the measurement of which is also described in the Farrington, Jr. et al. patents. In various embodiments, the MD Max Slope, expressed as kilograms per 3 inches of sample, can be about 10 or less, about 5 or less, and about 3 to about 6. The MD Stiffness Factor, expressed as (kilograms per 3 inches)-microns$^{05}$, in various embodiments can be about 150 or less, about 100 or less, and from about 50 to about 100.

Furthermore, the high bulk tissues of this invention in various embodiments can have a machine direction stretch of about 10 percent or greater, from about 10 to about 30 percent, and from about 15 to about 25 percent. In addition, the high bulk tissues can have a substantially uniform density since they are preferably through-dried to final dryness without any significant differential compression.

The uncreped through-dried tissues can have a high degree of surface topography or three dimensionality impressed and dried into the sheet from the various manufacturing fabrics. The combination of the high bulk and an irregular surface can make the tissue difficult to thread-up or turn-up. While not wishing to be bound by a particular theory, it is believed that the bulky sheet can be extruded by the nip forces while the irregular surface makes it difficult to attach the sheet to the reel spool surface. Irregardless of the above theory, uncreped through-dried tissue webs can result in poor machine efficiency during turn-up or threading.

Referring to FIG. 2, in one embodiment located along at least a portion of the transfer belt's predetermined path within the winding region 51 is a means for pressure reduction 58. However, the pressure reduction means can be eliminated or turned off when an impermeable transfer belt is used. The pressure reduction means reduces the pressure along a portion of an inside surface 60 of transfer belt 46. Such pressure reduction means can include without limitation, a vacuum box, a vacuum roll, a spoiler bar, a coanda vacuum box, a venturi, a fan, or a vacuum pump.

The pressure reduction means 58 is shown in more detail. As illustrated, a coanda vacuum box functions as the pressure reduction means 58 and is located in the winding region 51. Additionally, several coanda vacuum boxes are located in the web transport region 53. The coanda vacuum box uses high velocity air directed along a curved surface to create a low pressure zone upstream of the curved surface. Cuanda vacuum boxes are commercially available from Metso Corporation having an office at SE-651, Karlstad, Sweden. This type of pressure reduction means is suited for this application since it is not necessary for the coanda vacuum box to touch the inside surface 60 in order to create a reduced pressure adjacent inside surface 60. The coanda vacuum box can be located within one inch of the transfer belt and still have the desired functionality. However, other pressure reduction means such as a conventional vacuum box with seals to the moving transfer belt could be used.

The pressure reduction means 58 may span a substantial portion of the winding region 51 as illustrated. This is desirable since the winding tangent point of the parent roll 52 traverses the winding region as the roll's diameter increases. However, it is possible fort he pressure reduction means 58 to be located along only a portion of the winding zone 51 such as directly beneath the turn-up location 54'.

The pressure reduction means 58 reduces the pressure along inside surface 60 of the transfer belt 46. This in turn tends to create a reduced pressure on an outside surface 62 of the transfer belt 46 when the transfer belt is air permeable. As such, tissue sheet 40 is pulled or drawn into contact with the outside surface 62 of transfer belt 46. Depending on the amount of pressure differential created, it is possible to even drawn air through the tissue sheet 40 and transfer belt 46. Ordinarily, the pressure reduction means is operated at a low level, such as 0–2 inches of water, to prevent undo deflection of the transfer belt as a result of the pressure differential. A large pressure differential could destabilize the control system, which responds to belt deflection to control the position of the parent roll 52 as will be discussed in more detail later.

The pressure reduction means 58 in the winding region 51 functions to improve turn-up efficiency and to control sheet wandering within the winding region. By reducing the pressure along the inside surface 60, and through means of the permeable belt along the outside surface 62, the tissue sheet 40 is drawn and held in contact with the outside surface. As a turn-up progresses, the portion of the tissue sheet 40 between support roll 48 and parent roll 52 can be destabilized by the forces acting on the sheet during a turn-up. For instance, the spinning reel spool 54 can create enough windage to pull a portion of the tissue sheet away from the transfer belt 46 prior to contacting transfer belt 46. If the winding of the reel spool 54 is not started uniformly, the tissue often will tear and break the sheet before the turn-up is completed. The pressure reduction means 58 ensures the tissue sheet remains in contact with the transfer belt 46 until the reel spool 54 is in the proper location to initiate the turn-up and maintains the tissue sheet in contact with the transfer belt until the turn-up is completed.

Secondly, often times a turn-up will create loose or torn bits of the tissue sheet 40 as the sheet is ripped to start winding on reel spool 54. These smaller portions can be drawn into the winding on the new reel spool and tear the sheet resulting in a turn-up failure. The pressure reduction means 58 controls these loose/torn tissue web portions by conveying them away from the turn-up region on the outside surface 62 of the transfer belt. As a result, the turn-up efficiency may be improved.

In addition to locating the pressure reduction means 58 within the winding region 51, it is also possible to locate one or more pressure reduction means within the web transport region 53. In one embodiment, the pressure reduction means 58 are the coanda vacuum boxes previously described. Alternatively, other pressure reduction means can be used such as a conventional vacuum box. The pressure reduction means 58 may be located in an area when additional sheet stability is required. Such areas can include the area preceding support roll 48 or the area where dry end fabric 42 and the transfer belt 46 separate in order to ensure positive transfer of the tissue sheet 40 to the transfer belt. The pressure reduction means 58 in the web transport region 53 helps to stabilize the tissue sheet 40 reducing skating and weaving improving tissue machine runnability and the parent roll's uniformity. Generally, the coanda vacuum boxes in the web transport 53 region will operate at a vacuum level approximately equal to that of the coanda vacuum boxes in the winding region 51.

The turn-up and winding of the sheet is illustrated in more detail in FIG. 2. In the winding region 51, the sheet 40 contacts and transfers to the parent roll 52. Reference numbers 54, 54' and 54" illustrate three positions of the reel spool 54 during continuous operation. As shown, a new reel spool 54" is ready to advance to position 54' as the parent roll 52 is building. When the parent roll has reached its final predetermined diameter, the new reel spool is lowered by arm 70 into position 54' and against the incoming sheet at some point along the winding region 51 between the support rolls 48, 50. In one embodiment, the contact point is close to the first support roll 48 without touching the support roll so as to avoid a hard nip between the support roll and the reel spool.

At the appropriate time, one or more air jets 71 (FIG. 6) serve to blow the sheet 40 back toward the new reel spool 54' to aid in attaching the sheet to the new reel spool. Specifically, two side air jets can be located to blow towards the ends of the reel spool 54' and one or more air jets can be located adjacent to both edges of the sheet 40 blowing towards the cylindrical surface of the reel spool 54'. As the sheet is transferred to the new reel spool, the sheet is broken and the parent roll 52 is kicked out to continue the winding process with a new reel spool.

It is possible to complete the turn-up using the full width of the web or to reduce the web's width prior to executing the turn-up. It is also possible to cut or weaken the web in the cross-machine direction prior to executing a turn-up. For example, a series of water jets spanning the web's width could be quickly pulsed to either cut the web or weaken it in a cross-machine direction. The weakened portion or cut portion can readily attach to the reel spool to start a new parent roll. Such an apparatus is disclosed in U.S. Pat. No. 6,073,824 entitled Apparatus and Method for Cleanly Breaking a Continuously Advancing Cellulose Web issued Jun. 13, 2000 to Gray et al. herein incorporated by reference in a manner consistent herewith.

Figure 3:
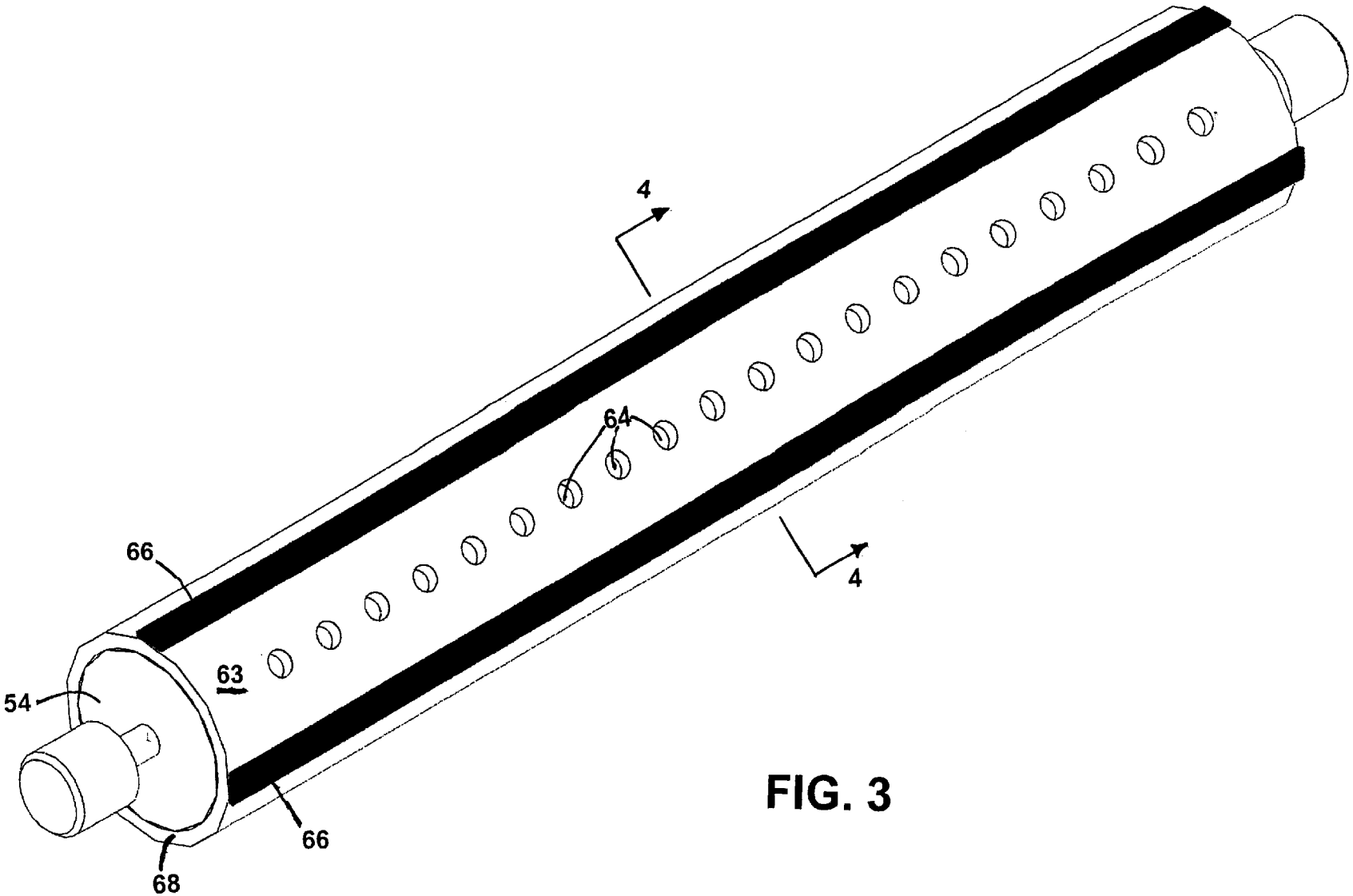
FIG. 3 illustrates a reel spool of the winding section.
Figure 4:
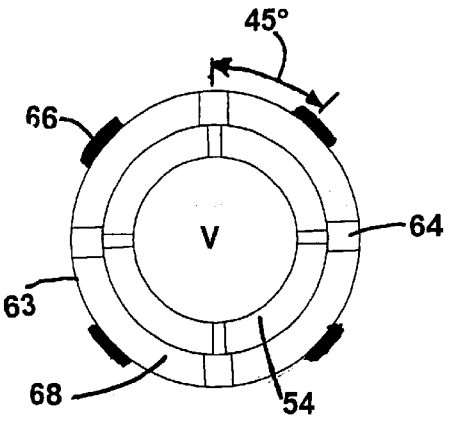
FIG. 4 illustrates a cross-section taken through line 4—4 of FIG. 3.

FIGS. 3 and 4 illustrate the reel spool 54 in more detail. The cylindrical surface 63 comprises a plurality of apertures 64, and at least one axial line of adhesive 66, which is shown with an enlarged thickness for illustration purposes in FIGS. 4 and 8. The plurality of apertures may be axial as shown, randomly spaced, or patterned on the cylindrical surface. The plurality of apertures should extend across a substantial portion of the length of the cylindrical surface, instead of being grouped on one end for threading a narrow tail. In the illustrated embodiment, the adhesive is applied to a core 68 that is placed over the reel spool for ease of removing the parent roll 52 from the reel spool. However, the adhesive and apertures could be located directly on the cylindrical surface of the reel spool instead of the core when winding without a core.

In one embodiment, the apertures and adhesive can extend greater than about 35 percent of the cylindrical surface length. In another embodiment, the apertures and adhesive can extend greater than about 50 percent of the cylindrical surface length. In another embodiment, the apertures and adhesive can extend greater than about 70 percent of the cylindrical surface length. In another embodiment, the apertures and adhesive can extend greater than about 90 percent of the cylindrical surface length. In another embodiment, the apertures and adhesive can extend from about 80 percent to about 100 percent of the cylindrical surface length.

It is not necessary that the apertures and adhesive extend for the same length on the cylindrical surface, or to be located symmetrically with respect to each other or with respect to the centerline of the reel spool. For instance, the adhesive can extend 35 percent while the apertures can extend 80 percent of the cylindrical surface length. Thus, each of the above ranges should be considered as individual to the apertures or to the adhesive. As used herein "percent of the cylindrical surface length" is defined as the maximum length of the adhesive axial line (ML), totaled if more than one adhesive segment is used, or the maximum length from the first aperture nearest one end to the last aperture nearest the opposite end of the reel spool (ML), as a percentage of the cylindrical surface length (CSL). Percent of the cylindrical surface length=ML/CSL*100. It is possible for the percentage to exceed 100% when the adhesive line or apertures are at an angle or a helix, since ML could then exceed the length of CSL.

The function of the axial adhesive line is to rip or sever the tissue web across a substantial portion of the web. The ripping and severing should be completed in less than one reel spool rotation, but it is not necessary for the rip to be perfectly straight across the web. Thus, as used herein, "axial line" means a line that extends across the cylindrical surface, which may be segmented or dashed. It is not necessary for the line to be perfectly straight across the cylindrical surface. The line may be a helix, may contain curves, may be a chevron, or may be another deviation from straight as long as line's two ends are not more than about 180 degrees apart circumferentially without wrapping the spool completely.

The apertures 64 are operatively connected to a source of vacuum V applied to one end of the reel spool that creates a reduced pressure inside the reel spool as shown in FIG. 4. In one embodiment, the vacuum is 18" of mercury (" Hg). However, the vacuum level may vary depending on the specific application. In other embodiments, the vacuum level can be from about 5" Hg to about 20" Hg.

In one embodiment, there are four axial lines of apertures spaced apart from each other by about 90 degrees. The apertures in the reel spool are 10 mm in diameter and are spaced every 150 mm axially over the cylindrical surface length. The apertures in the core are 32 mm in diameter and are spaced 150 mm axially to correspond with the apertures in the reel spool. The holes in the core are larger to increase the surface area, and therefore to lessen the vacuum level applied to the web. Other size diameters, other shaped apertures, other patterns, or spacing may be used depending on the specific application.

The adhesive 66 can be either a liquid adhesive or double sided tape adhesive. A suitable liquid adhesive is Tissue Tak 250, available from National Starch and Chemical Company having an office in Chicago, Ill. A suitable double sided tape adhesive is Scotch brand 9022 tape, available from 3M Corporation having an office in St. Paul, Minn. In one embodiment, the width of the axial line of adhesive was 50 mm. However, the width of the adhesive can vary depending on the specific application. In other embodiments the width can be from about 25 mm to about 100 mm.

Figure 8:
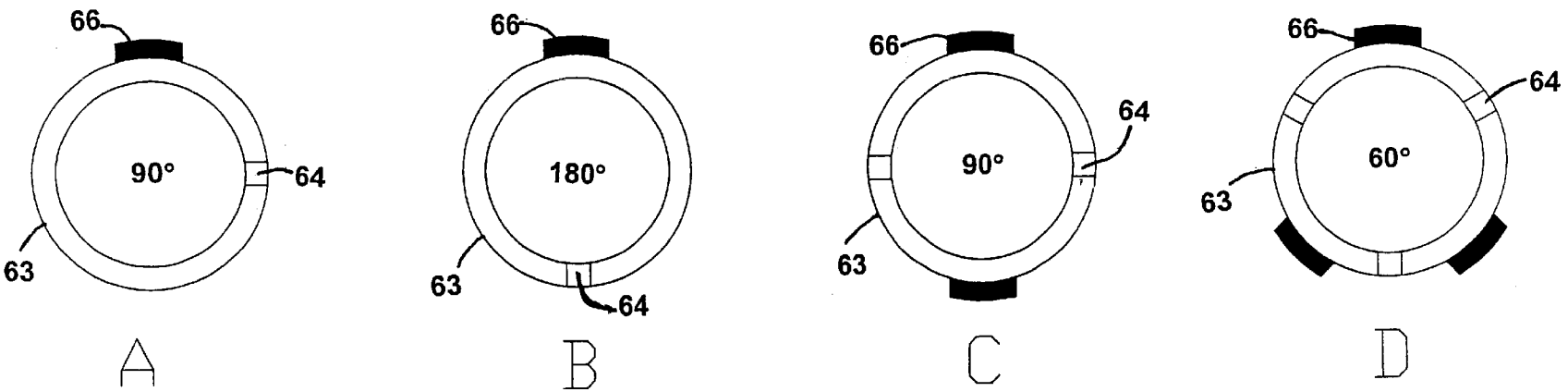
FIG. 8 illustrates cross-sections of alternative embodiments for the reel spool.

In one embodiment, four axially extending 50 mm wide lines of adhesive were applied to the core and spaced apart from each other by about 90 degrees. The axial adhesive lines and the axial plurality were alternated and spaced such that each was about 45 degrees aparts as illustrated in FIG. 4. Other possible embodiments for the spacing of axial adhesive lines and axial apertures lines are illustrated in FIG. 8. FIG. 8 includess arrangements for 1, 2, and 3 lines of adhesive and lines of apertures at various circumferential spacing.

Table 1 lists the results of trials evaluating turn-up efficiency of four equally spaced adhesive lines, four equally spaced axial plurality of apertures, and for the both as illustrated FIG. 4. The data was obtained during machine trials completed August, 2002, The data was collected by increasing the speed at each cindition until it was impossible to execute a successful turn-up. Surprisingly the turn-up efficiency when using axial adhesive lines alone was 0 percent at speeds of 3,700 fpm and adove. In others words, no turn-ups or thread-ups were successful at these speeds simply use of the adhesive alone.

TABLE 1

TURN-UP EFFICIENCY

| MODE | Speed (fpm) | Efficiency (percent) |
|---|---|---|
| Adhesive Alone | 3700 | 0 |
| Apertures Alone | 3700 | 83 |
| | 3800 | 56 |
| | 4000 | 67 |
| | 4200 | 0 |
| Adhesive and Apertures | 3700 | 100 |
| | 4000 | 75 |

Figure 5:
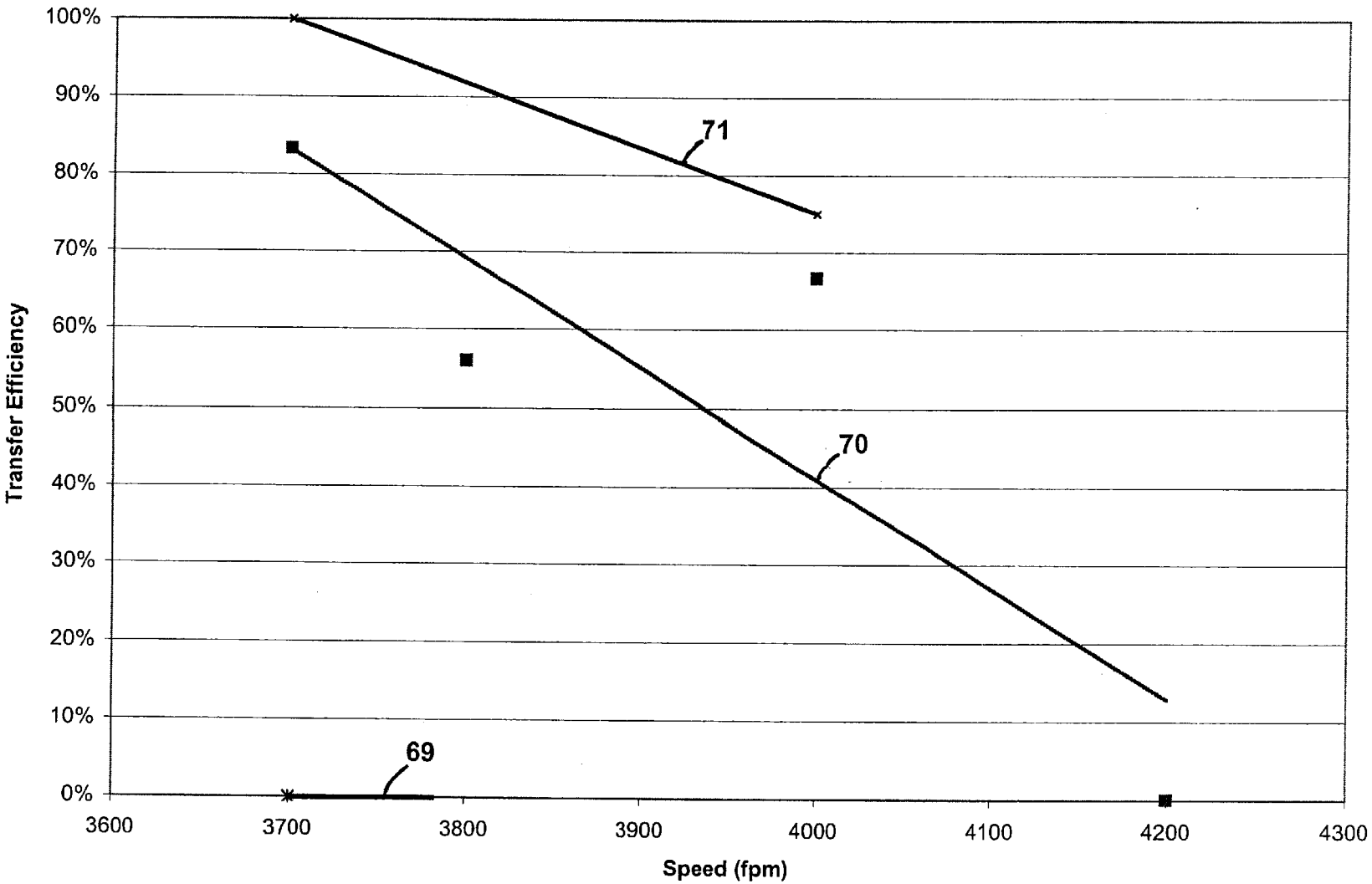
FIG. 5 illustrates a graph of turn-up efficiency.

The results of Table 1 are plotted in FIG. 5 where line 69 represents the fur axial lines of adhesive, line 70 represents the four axial lines of the apertures, and line 71 represents the reel spool illustrated in FIG. 4 having both adhesive lines and aperture lines. As seen in Table 1 and FIG. 5, the reel spool of FIG. 4 has improved turn-up efficiencies compared to either mode separately. In one embodiment, the use of both adhesive and apertures results in a tun-up efficiency greater than about 85 percent at a machine spped of about 3700 fpm, and in a turn-up efficiency greater than about 70 percent at a machine spped of about 4000 fpm.

While not wishing to be bound by theory, it is believed that the lack of a "hard nip" between the reel spool and a conventional metal reel drum, in combination with the surface topography and bulk of the uncreped through-dried tissue prevented the adhesive from performing an efficient turn-up. While the adhesive could help to initiate a rip in the tissue web for starting the turn-up, it was ineffective to control the winding once the transfer was initiated. Once one complete revolution of the reel spool occurred, the tape could no longer influence the winding to help control sheet extrusion of the bulky, three dimensional tissue web. The addition of vacuum is believed to help tighten up the winding, since the vacuum action could attract additional layers of tissue to the reel spool even though the apertures were covered by one or more wraps of tissue. The addition of vacuum is also believed to help attach the tissue sheet to the reel spool with the adhesive in the absence of a hard nip. The vacuum may help attract the sheet to the reel spool assisting in the attachment of the sheet to the adhesive.

As used herein, a "hard nip" is defined to be a nip between the reel spool or cardboard core and a conventional metal reel drum. For instance, contact pressures for a 20 inch diameter reel spool in contact with a 43.4 inch diameter metal reel drum can be approximately 16 psi when the reel spool is held against the drum with a linear load of 4.7 pli. Similar calculations for various radii cores and differencing materials in the nip show that the peak contact pressures can vary from about 15psi to about 55 psi under a linear load of 4.7 pli.

For a "soft nip", such as between the reel spool and the transfer belt, the discovery of vacuum, in addition to adhesive, greatly improved turn-up efficiency. Contact pressure calculations for a 20 inch diameter spool pressed against the compliant transfer belt yield pressures of approximately 1 psi, based on the radius of the reel spool and the transfer belt tension. As shown, the soft nip reel has a greatly reduced nip pressure in comparison to a conventional hard nip reel. Examples of soft nips include, without limitation, a reel spool or core pressed against a transfer belt, or an elastomeric cover, such as rubber, on a reel drum surface or a reel spool surface or both in nip contact. In various embodiments, the soft nip can have a contact pressure less than about than about 8 psi, less than about 4 psi, from about 6 psi to about 0.1 psi, or from about 3 psi to about 0.1 psi.

Figure 6:
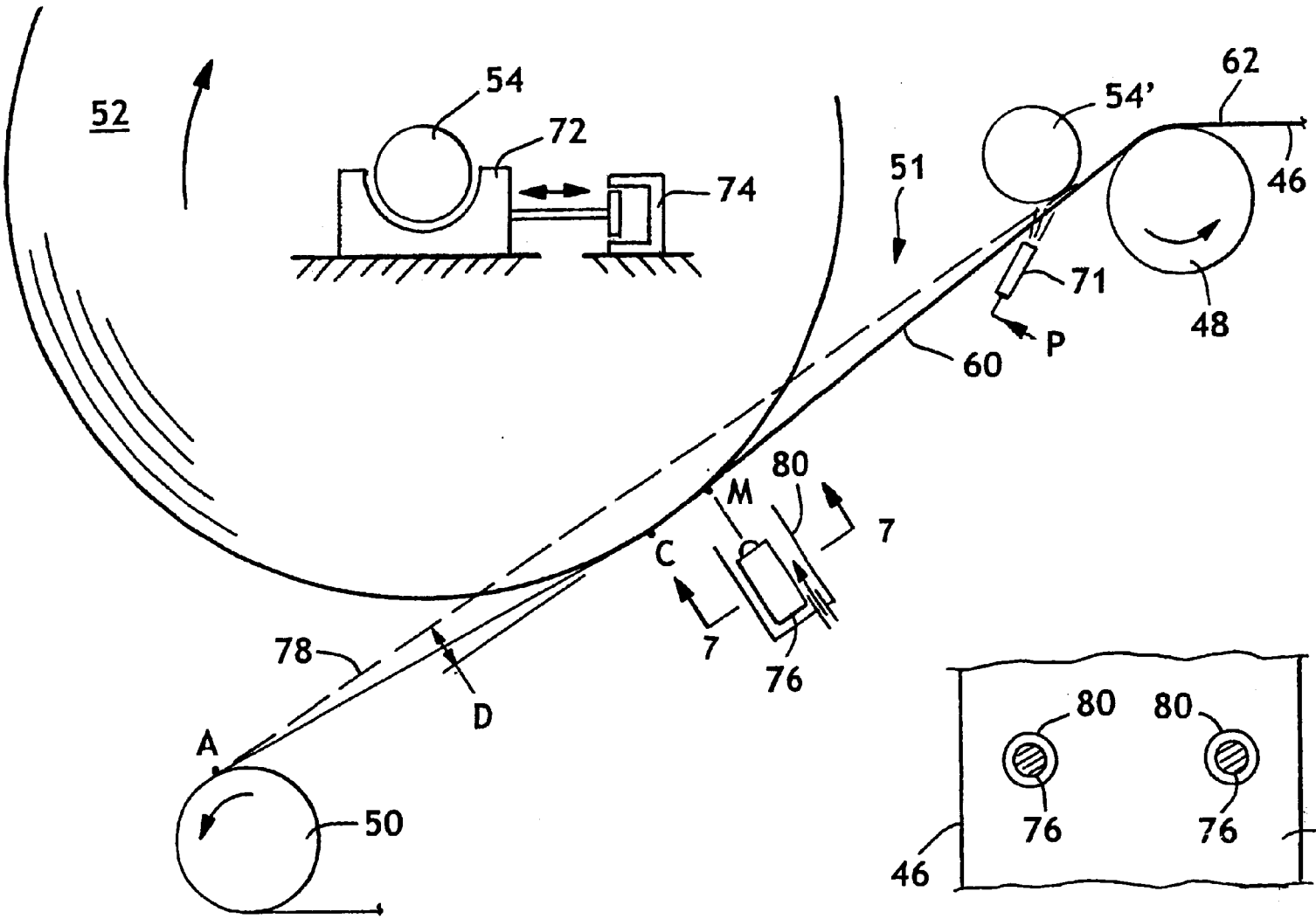
FIG. 6 illustrates an enlarged schematic diagram of the winding section, illustrating the operation of a displacement sensor in controlling the transfer belt displacement.

Referring now to FIG. 6, more details of the reel are illustrated. The previously discussed pressure reduction means 58 illustrated in FIG. 2 are removed for clarity. The reel spool 54 is supported appropriately by a pair of carriages 72, one of which is illustrated in FIG. 6. As the parent roll 52 builds, the reel spool moves toward the other support roll 50 while at the same time moving away from the transfer belt 46. The reel spool 54 can be moved in either direction by a hydraulic cylinder 74 as illustrated by the double-ended arrow to maintain the proper transfer belt deflection needed to minimize the variability of the sheet properties during the winding process. As a result, the parent roll nip substantially traverses the winding region 51 as the roll builds to its predetermined size.

Control of the relative positions of the reels pool 54 and the transfer belt 46 is suitably attained using a non-contacting sensing device 76 which is focused on surface 60 of the transfer belt 46, preferably at a point M midway between the two support rolls (48, 50) as illustrated in FIG. 6. One object is to control the pressure exerted by the parent roll 52 against the tissue sheet supported by the transfer belt 46 as well as controlling the nip length created by the contact. The sensing device 76, such as a laser displacement sensor discussed below, detects changes in transfer belt deflection of as small as 0.005 inches. A predetermined baseline value from which the absolute amount of deflection D can be ascertained is the undeflected travel path of the transfer belt 46 illustrated by a dashed line 78.

A particularly suitable laser sensing device 76 is laser displacement sensor Model LAS-8010, manufactured by Nippon Automation Company, Ltd. and distributed by Adsens Tech Inc. Other suitable contacting and non-contacting displacement sensing devices known to those of skill in the art can be used as well. The Nippon Automation LAS 8010 sensor has a focused range of 140 to 60 mm and is connected to a programmable logic controller. The front plate of the sensor can be mounted 120 mm from the inside surface of the transfer belt. Such a sensor is designed to give a 4 to 20 mA output in relation to the minimum to maximum distance between the sensor and the transfer belt. The winder is first operated without a parent roll 52 loaded against the transfer belt 46 to set the zero point in the programmable logic controller based on the undeflected path of travel 78 of the transfer belt.

The laser sensor 76 can be mounted within an air purge tube 80 which maintains an air flow around the laser to prevent dust from settling on the lens of the laser and interfering with the operation of the device. The laser and air tube can be incorporated into a single longer coanda vacuum box mounted adjacent the transfer belt 46 in the winding region 51, or two shorter coanda vacuum boxes can be located on either side of the laser's position.

Once the transfer belt deflection D has been measured, a proportional only control loop associated with the programmable logic controller preferably maintains that deflection at a constant level. In particular, the output of this control is the setpoint for a hydraulic servo positioning control system for the carriages 72, which hold the reel spool 54 and building parent roll. Other mechanical and electrical actuators for positioning the reel spool 54 in response to the sensor 76 in order to maintain a constant deflection D can be designed and constructed by those skilled in the art of building winders. When the transfer belt deflection D exceeds the setpoint, the carriage position setpoint is increased, thereby moving the carriages 76 away from the transfer belt returning the deflection to the setpoint.

Control of the web properties of the web unwound from the parent roll 52 can be aided by imparting a predetermined amount of web tension to the incoming web during winding, such as by programming the level of speed difference between the transfer belt 46 and the outer surface of the building parent roll 52. In most instances, a positive draw (the percentage by which the speed of the surface of the parent roll exceeds the speed of the transfer belt) is required at the parent roll in order to impart the web tension needed to provide a stable parent roll. On the other hand, too much positive draw will unacceptably reduce the machine direction stretch in the web. Therefore, the amount of positive draw will depend upon the web properties coming into the parent roll and the desired properties of the web to be unwound from the parent roll. Generally, the speed of the surface of the parent roll will be about 10 percent or less faster than the speed of the transfer belt, more specifically from about 0.5 to about 8 percent faster, and still more specifically from about 1 to about 6 percent faster. Of course, if the web approaching the parent roll already has sufficient tension provided by other means earlier in the tissue making process, a negative or zero draw may be desirable.

Figure 7:
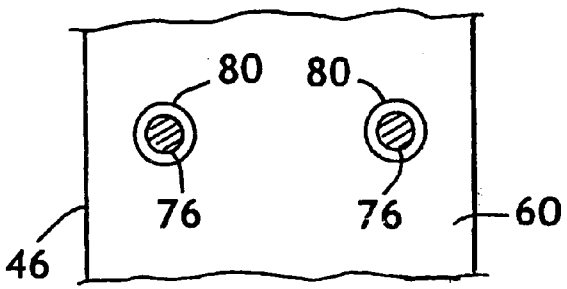
FIG. 7 illustrates a partial sectional view taken through line 7—7 of FIG. 6.

The transfer belt deflection control may use two laser distance sensors 76 sensing the surface 60, and located adjacent a respective edge of the transfer belt 46 so as to be spaced from each other in the cross machine direction as can be seen in FIG. 7. As such, undesirable tapering of the roll 52 can be minimized or a positive taper can even be introduced intentionally to improve the winding parameters of the particular roll being wound.

A specific hydraulic servo positioning system consists of Moog servo valves controlled by an Allen-Bradley QB module with Temposonic transducers mounted on the rods of the hydraulic cylinders 74 to determine position. The output from the deflection control loop is the input to two individual servo positioning systems on either side of the reel. Each system can then control, keeping the two sides of the reel parallel if desired. A protection system that stops the operation if the parallelism exceeds a certain threshold level may be desirable, but it is not necessary to have an active system to keep the two sides parallel.

The extent to which the transfer belt 46 is deflected is suitably maintained at a level of about 20 millimeters or less, more specifically about 10 millimeters or less, still more specifically about 5 millimeters or less, and still more specifically from about 1 to about 10 millimeters. In particular, the control system preferably maintains the actual transfer belt deflection at the nip at a level of about 4 mm±2 mm. Maintaining the transfer belt deflection within this range has been found to allow the parent roll 52 and the transfer belt 46 to operate with a relative speed differential but without significant power transfer. This will allow control of the winding process to maintain substantially constant sheet properties throughout the parent roll 52.

Deflection is measured perpendicular to the undeflected path of travel 78 of the transfer belt 46. It would be appreciated that the acceptable amount of deflection for any given tissue sheet is in part determined by the design of the transfer belt 46 and the tension imparted to the transfer belt during operation. As the tension is reduced, the acceptable a mount of deflection will increase because the compression of the sheet is reduced and the amount of power transferred to the parent roll 52 is further reduced. In turn, the variability in the properties of the wound sheet is reduced. In addition, it may not always be desirable to maintain the amount of transfer belt deflection D at a substantially constant level and it is within the scope of the invention that the amount of deflection may be controllably varied as the roll 52 increases in diameter.

The sensed deflection D of the transfer belt 46 in combination with the sensed position of the reel spool carriages 37 may also be used to calculate the diameter of the building parent roll 52. The value calculated for the diameter of the roll can be useful in varying other operating parameters of the winding process including the rotational velocity at which the reel spool 54 is rotated by the drive motor 56 to maintain the same draw or speed relationship between the outer surface of the parent roll 52 and transfer belt 46 as the diameter of the parent roll increases.

The laser sensor 76 can be positioned to always measure the deflection of the transfer belt 46 at the midpoint the winding region 51 free span, regardless of the parent roll position, and the actual deflection can be calculated as described below. Alternatively, the laser sensor 76 can traverse the free span with the parent roll nip such that the laser always measures the deflection directly. A further alternative is to mount the laser sensor 35 for rotation so that the laser light source can be rotated to maintain a desired aim on the transfer belt 46.

In the situation where the laser position is fixed at the midpoint of the free span and the deflection is measured by the laser 76 at that point, the actual deflection at the parent roll nip point is calculated according to the position of the building parent roll 52, which traverses from one end of the open span to the other on the carriages 72 while it builds. Since the laser 76 is mounted in the middle of the free span of the transfer belt 46 between the two support rolls (48, 50) and only measures the deflection of the transfer belt at that position, the actual deflection at the nip is closely approximated by the measured deflection in the middle of the free span times the following ratio: the distance from the laser measurement point M to the nip point A of the support roll nearest the nip point C of the parent roll (support roll 50 in FIG. 6) divided by the distance from the nip point of the parent roll C to the nip point of that same support roll A. For purposes of this calculation, the nip points of the support rolls are the tangent points at which the undeflected path of travel 78 of the transfer belt in the free span contacts the support rolls. The nip point C of the parent roll is the midpoint of the wrap of the transfer belt 46 around the periphery of the parent roll 25.

This is illustrated in FIG. 6, where the actual deflection D is the measured deflection at point M (the midpoint of the free span) times the ratio of the distance MA to the distance CA. If the parent roll 52 was precisely in the middle of the free span, the ratio would be 1 and the laser would be measuring the actual deflection D. However, when the parent roll 52 is positioned on either side of the midpoint of the free span, the deflection of the transfer belt measured by the laser at the midpoint is always less than the actual deflection at the transfer point.

The length of the unsupported winding zone 51 between the support rolls 48, 50 needs to be long enough to allow the new reel spool 54' to be placed between the first or upstream support roll 48 and the full-sized parent roll. On the other hand, the free span needs to be short enough to prevent sagging of the fabric so that the amount of tension can be minimized and the degree of deflection can be controlled. A suitable winding zone length can be from about 1 to about 5 meters, and more specifically from about 2 to about 3 meters.

The advantages of the apparatus and method according to the present invention allow the production of parent rolls of tissue having highly desirable properties. In particular, parent rolls of high bulk tissue can be manufactured having a diameter of about 70 inches or greater, wherein the bulk of the tissue taken from the roll is about 9 cubic centimeters per gram or greater, the coefficient of variation of the finished basis weight is about 2% or less and the coefficient of variation of the machine direction stretch is about 6% or less. In addition, the coefficient of variation of the sheet bulk for tissue sheets taken from the parent roll can be about 3.0 or less.

More specifically, the diameter of the parent roll can be from about 100 to about 150 inches or greater. The coefficient of variation of the finished basis weight can be about 1% or less. T he coefficient of variation of the machine direction stretch can be about 4% or less, still more specifically about 3% or less. The coefficient of variation of the sheet bulk can be about 2.0 or less.

An advantage of the method of this invention is the resulting improved uniformity in the sheet properties unwound from the parent roll. Very large parent rolls can be wound while still providing substantial sheet uniformity due to the control of the winding pressure on the sheet. Another advantage of the method of this invention is that soft, high bulk tissue sheets can be wound into parent rolls at high speeds. Suitable machine speeds can be from about 3000 to about 6000 feet per minute or greater, more specifically from about 4000 to about 6000 feet per minute or greater, and still more specifically from about 4500 to about 6000 feet per minute.

Many modifications and other embodiments of the invention will come to mind to one skilled in the art to which this invention pertains having the benefit of the teachings presented in the foregoing descriptions and the associated drawings. For example, the apparatus and method according to the present invention are not limited to use with only tissue, but may also be highly advantageous in winding all types of web materials, including other forms of paper such as paperboard. In addition, as used herein and in the claims forms of the words "comprise", "have", and "include" are legally equivalent and are open-ended. Therefore, additional non-recited elements, functions, steps, or limitations may be present in addition to the recited elements, functions, steps, or limitations.

Although specific terms are employed herein, they are used in a generic and descriptive sense only and not for purposes of limitation. It is to be understood that the invention is not to be limited to the specific embodiments disclosed and that modifications and other embodiments are intended to be included within the scope of the appended claims.

We claim:

1. An apparatus comprising:

a reel spool comprising a cylindrical surface, the cylindrical surface comprising at least one axial line of adhesive and a plurality of apertures operatively connected to a source of vacuum.

2. The apparatus of claim 1 wherein the plurality of apertures comprise an axial line.

3. The apparatus of claim 2 wherein the adhesive line is spaced circumferentially about 90 degrees from the axial line of a plurality apertures.

4. The apparatus of claim 2 wherein the adhesive line is spaced circumferentially about 180 degrees from the axial line of a plurality apertures.

5. The apparatus of claim 2 comprising at least two axial lines of adhesive and at least two axial lines of a plurality of apertures operatively connected to a source of vacuum.

6. The apparatus of claim 5 wherein the two axial lines of adhesive are spaced circumferentially about 180 degrees apart, the two axial lines of a plurality of apertures are spaced circumferentially about 180 degrees apart, and the adjacent adhesive lines and aperture lines are spaced circumferentially about 90 degrees apart.

7. The apparatus of claim 2 comprising at least three axial lines of adhesive and at least three axially lines of a plurality of apertures operatively connected to a source of vacuum.

8. The apparatus of claim 7 wherein the three axial lines of adhesive are spaced circumferentially about 120 degrees apart, the three axial lines of a plurality of apertures are spaced circumferentially about 120 degrees apart, and adjacent adhesive lines and aperture lines are spaced circumferentially about 60 degrees apart.

9. The apparatus of claim 2 comprising at least four axial lines of adhesive and at least four axially lines of a plurality of apertures operatively connected to a source of vacuum.

10. The apparatus of claim 9 wherein the four axial lines of adhesive are spaced circumferentially about 90 degrees apart, the four axial lines of a plurality of apertures are spaced circumferentially about 90 degrees apart, and the adjacent adhesive lines and aperture lines are spaced circumferentially about 45 degrees apart.

11. The apparatus of claim 1 wherein the cylindrical surface is located on a core placed on the reel spool.

12. An apparatus comprising:

a reel spool comprising a cylindrical surface;

the cylindrical surface comprising at least one axial line of adhesive and a plurality of apertures operatively connected to a source of vacuum, and a soft nip.

13. The apparatus of claim 12 wherein the soft nip comprises the reel spool loaded against a transfer belt.

14. The apparatus of claim 12 wherein the soft nip comprises the reel spool loaded against a reel drum having an elastomeric cover.

15. The apparatus of claim 12 wherein the soft nip comprises the reel spool having an elastomeric cover loaded against a reel drum.

16. The apparatus of claim 13 further comprising a tissue sheet having a bulk greater than about 6 cubic centimeters per gram located in the soft nip between the reel spool and the transfer belt.

17. The apparatus of claim 16 wherein the tissue sheet has a bulk from about 9 cubic centimeters per gram to about 15 cubic centimeters per gram.

18. The apparatus of claim 12 wherein the plurality of apertures comprise an axial line.

19. The apparatus of claim 12 wherein the soft nip has a contact pressure less than about 8 psi.

20. The apparatus of claim 12 wherein the soft nip has a contact pressure from about 6 psi to about 0.1 psi.

21. The apparatus of claim 12 wherein the cylindrical surface is located on a core placed on the reel spool.

22. An apparatus comprising:

a reel spool comprising a cylindrical surface, the cylindrical surface comprising at least one axial line of adhesive and at least one axial line of a plurality of apertures operatively connected to a source of vacuum;

a transfer belt mounted for rotation around a plurality of support rolls defining a predetermined path of travel, the predetermined path of travel having a winding region and a web transport region;

a sensor measuring a deflection of the transfer belt in the winding region from the predetermined path of travel;

an actuator for positioning the reel spool and the transfer belt relative to each other to vary the deflection; and a controller connected to the sensor and the actuator for controlling the deflection.

23. The apparatus of claim 22 further comprising a means for pressure reduction located along at least a portion of the predetermined path of travel in the winding region.

24. The apparatus of claim 23 wherein the pressure reduction means comprises a coanda vacuum box.

25. The apparatus of claim 22 further comprising a tissue sheet having a bulk greater than about 6 cubic centimeters per gram located in the winding region between the reel spool and the transfer belt.

26. The apparatus of claim 22 wherein the reel spool comprises four axial lines of adhesive spaced circumferentially about 90 degrees apart, four axial lines of a plurality of apertures spaced circumferentially about 90 degrees apart, and the adjacent adhesive lines and aperture lines are spaced circumferentially about 45 degrees apart.

27. A method comprising:

creating a vacuum inside of a reel spool;

contacting the reel spool with a web; and the reel spool comprising a cylindrical surface, at least one axial line of adhesive, and a plurality of apertures.

28. The method of claim 27 comprising blowing air at the cylindrical surface or the web.

29. The method of claim 27 wherein the contacting causes a turn-up.

30. The method of claim 29 wherein the web is traveling at a speed of about 3700 fpm, and the turn-up has a turn-up efficiency greater than about 85 percent.

31. The method of claim 29 wherein the web is traveling at a speed of about 4000 fpm, and the turn-up has a turn-up efficiency greater than about 70 percent.

32. The method of claim 29 comprising reducing the width of the web prior to contacting the web.

33. The method of claim 27 comprising supporting the web on a transfer belt having a winding region.

34. The method of claim 33 comprising reducing the pressure along at least a portion of the winding region.

35. The method of claim 27 comprising weakening the web prior to the contacting.

36. The method of claim 27 comprising cutting the web prior to the contacting.

* * * * *